United States Patent [19]

Ben-Dov

[11] Patent Number: 4,590,479

[45] Date of Patent: May 20, 1986

[54] BROADCAST ANTENNA SYSTEM WITH HIGH POWER AURAL/VISUAL SELF-DIPLEXING CAPABILITY

[75] Inventor: Oded Ben-Dov, Medford, N.J.

[73] Assignee: RCA Corporation, Princeton, N.J.

[21] Appl. No.: 594,848

[22] Filed: Mar. 29, 1984

[51] Int. Cl.[4] ..... H01Q 13/12

[52] U.S. Cl. ..... 343/771; 343/890; 333/122; 333/126

[58] Field of Search ..... 343/767, 768, 769, 770, 343/771, 874, 875, 756, 890; 333/122, 117, 126, 135, 137; 455/80, 81, 129; 370/37–40

[56] References Cited

U.S. PATENT DOCUMENTS

| | | | |
|---|---|---|---|
| 2,686,901 | 8/1954 | Dicke | 333/122 |
| 2,807,018 | 9/1957 | Woodward | 343/770 |
| 2,947,988 | 8/1960 | Masters | 343/770 |
| 2,981,947 | 4/1961 | Bazan | 343/770 |
| 3,019,438 | 1/1962 | Pan | 343/843 |
| 4,074,265 | 2/1978 | True | 333/122 |
| 4,240,155 | 12/1980 | Vaughan | 370/69 |

*Primary Examiner*—Eli Lieberman
*Assistant Examiner*—Michael C. Wimer
*Attorney, Agent, or Firm*—Joseph S. Tripoli; Robert L. Troike; William H. Meise

[57] ABSTRACT

A high-power broadcast television arrangement includes high-power aural and visual carrier sources with rectangular waveguide outputs. A circular waveguide connects the antenna at the top of a tower with the bottom of the tower. In order to avoid an expensive, lossy and complex diplexer for combining the visual and aural carrier signals into a single waveguide, a waveguide turnstile junction couples the visual and aural signals from their respective rectangular waveguides into right- and left-hand circular polarization propagation modes in the circular waveguide. A hollow cylindrical slotted-waveguide antenna at the top of the tower receives the dual-polarized aural and visual signals received from the circular waveguide and radiates a television signal with the aid of resonant radiating slots and polarization-insensitive couplers.

5 Claims, 7 Drawing Figures

BROADCAST ANTENNA SYSTEM WITH HIGH POWER AURAL/VISUAL SELF-DIPLEXING CAPABILITY

This invention relates to a broadcast antenna system including a tower and an omni-directional television slot antenna having high power aural/visual self-diplexing capability.

Television broadcasters desire to reach the largest number of viewers with their signals, and this, generally speaking, requires that they cover the largest possible area with their signals. Coverage of a large area with television signals, which generally lie in the UHF and VHF frequency ranges, requires that the television transmitting antenna be located at a location having a line-of-sight relationship to the viewer's antenna. Additionally, adequate coverage of a large area requires very high transmitting power for application to the antenna, and also requires a high antenna gain. In order to maximize the effectiveness of the antenna, the high gain is provided in the horizontal plane, by providing a very narrow elevation beam width and a broad (often omni-directional) azimuth beam width.

The height of the tower is generally limited by economic considerations, which in turn arise from several factors including the amount of signal lost between the antenna and the source of high-power television signals located near the base of the tower, and also limited by the wind load on the antenna, tower and other supporting structures.

In order to provide high gain on the horizon, the antenna must consist of a large number of radiators (an "array" of radiators) stacked vertically to provide the desired gain. Thus, the array of radiators is large in the vertical direction. In order to provide omni-directional operation in the azimuth direction, the antenna must, generally speaking, be in a location where it is not surrounded by wires or other conductors, which might re-radiate and thereby perturb the electromagnetic field. For this reason, the UHF broadcast antenna often consists of a hollow cylindrical conductor through the center of which the signals are applied from the source of signals and which includes slots cut into or through the conductor to couple signals from the interior to the exterior of the cylinder in order to provide the desired radiation. Such antennas consisting of slots cut into a conductive cylinder are known as "pylon" antennas. In order to handle the high power signal, the interior of the cylinder must be reasonably large (otherwise voltage breakdown in the form of arcing can take place), and therefore the wind load on the cylinder can be reasonably large under conditions of design maximum high winds. Because the antenna cannot be supported by guy wires connected to the top of the radiating portion due to the aforementioned considerations of radiation pattern, the mechanical forces due to wind which tend to twist the antenna from the top of the tower must be resisted by the structure of the conductive cylinder itself and transferred to a flange, which is generally welded to the bottom of the cylinder, and which is bolted to the top of the tower. Thus, these forces on the conducting cylinder are transferred to the tower. The tower is designed to support the weight of the antenna, tower and supporting structures, but the (lateral) wind loads are transferred to guy wires attached to the tower at various locations and connected to anchors in the ground.

The television signals include video signals amplitude-modulated onto a visual carrier, often in the UHF frequency range, and also include audio signals frequency-modulated onto an aural carrier. The center frequency of the aural carrier is generally 4 to 6 MHz above the visual carrier frequency (in the United States, the difference is 4.5 MHz). The power of the aural carrier is generally in the range of −7 to −10 dB relative to the peak visual carrier power level. At the very high power required for broadcast applications (up to 250 KW peaks) the active devices of the source of signals are coaxial triodes, klystrons, and the like. These active devices tend to be nonlinear at high powers. In order to avoid interaction between the visual and aural carriers due to the nonlinearity, and also in order to achieve the highest possible power level for a given active device, it is common to produce the high-power visual and aural signals separately, and to combine them for application to the antenna. The combining of the signals is ordinarily accomplished by a diplexer, which is a device including first and second input ports for receiving high-power signals from the visual and aural signal sources, and for coupling them to a single transmission line. Such diplexers generally use resonant filters to act differently on the visual and aural carriers in order to provide the desired coupling together of the two signals, while isolating the signal sources form each other in order to prevent undesired interaction. The filters unavoidably have undesired phase-shifting and amplitude effects at the adjacent off-resonant frequencies, because the finite Q of realizable filters is insufficient to eliminate effects only 4.5 MHz away from a center frequency which may be as high as 800 MHz.

The finite Q of the filters of a diplexer also may result in undesirably high power losses. Since the cost of making the high-power signals is the continuing cost required to pay for electric energy, and because electric energy is becoming increasingly expensive, it is very important to reduce to a minimum the power losses between the high-power source of signals and the antenna.

The diplexers are also expensive because of the high-Q filters and the requisite stability and adjustment.

In order to provide high power signals from the source of signals (which is often a klystron or other amplifier) located near the bottom of the tower, a transmission line is coupled from the source of signals to the base of the conducting cylinder for coupling signal to the cylinder and to the slot radiators. Because such towers may be very tall, (up to 2000 feet high) it is very important that the transmission line have low loss so the maximum amount of power is coupled to the antenna. Transmission lines are used to couple the signal from the source of signals to the top of the tower, because other conductors may undesirably cause radiation directly from the conductors, which adds to the signal from the antenna and create a perturbed radiation pattern. Two-wire transmission lines are not often used because they depend for proper operation upon complete balance of the fields, which is very difficult to achieve in the environment of a tower consisting of conductive structural members. A two-wire transmission line undesirably radiates and may have a poor impedance match which reflects energy back to the source of signals. A commonly used transmission line is a coaxial transmission line, which consists of two concentric conductors, which is very advantageous because of its reasonably low loss characteristics and because it provides complete shielding of the signal between the source and the top of the tower. Also highly advantageous is the waveguide, which generally consists of an empty cylinder of conductive material having a circular or rectangular cross-section, through which the energy flows in the form of electromagnetic fields. The waveguide is characterized by very low loss and very inexpensive construction due to the absence of a center conductor and absence of the "bullets" necessary to connect together sections of the center conductor of the coaxial line, and is particularly advantageous for the run up the length of the tower in the form of a circular or elliptical waveguide which has lower wind loading then rectangular waveguide. A broadcast antenna system is desired which avoids the need for a lossy diplexer.

SUMMARY OF THE INVENTION

A television broadcasting arrangement according to the invention includes a source of UHF visual signals and a source of UHF aural signals to be broadcast. The broadcasting is accomplished by a slotted-circular-waveguide UHF antenna having a ciruclar-waveguide input port. In order to locate the slotted waveguide antenna for broad coverage, the slotted antenna is mounted upon a tower. In order to couple the antenna to a source of signals, a circular-waveguide is coupled to the input port of the antenna and extends along the length of the tower to a location adjacent the base of the tower. For maximum power generation, the visual and aural television signals are generated separately. A turnstile junction includes first and second pairs of orthogonal rectangular waveguide input ports. The first pair of input ports includes first and second ports, and the second pair of ports comprises third and fourth ports. The turnstile junction also has a circular waveguide port orthogonal to the first and second pairs of rectangular waveguide ports. A first rectangular waveguide couples the source of visual signals to the first rectangular waveguide input port of the turnstile junction. A second rectangular waveguide couples the source of aural signals to the second rectangular waveguide input port of the turnstile junction. Reactive terminations are coupled to the ports of the second pair of ports of the turnstile junction for causing the turnstile junction to propagate the visual signal to the circular waveguide port of the turnstile junction with a first hand of circular polarization and for causing the turnstile junction to propagate the aural signal to the circular waveguide port of the turnstile junction with a second hand of circular polarization. The circular waveguide port of the turnstile junction is coupled to the end of the circular waveguide extending along the length of the tower for propagating visual and aural signals with mutually opposite hand circular polarization to the antenna. Couplers associated with the antenna slots respond to the left and right hands of circular polarization independently of the polarization, to couple the visual and aural signals to the slots for radiation.

DESCRIPTION OF THE INVENTION

Figure 1:
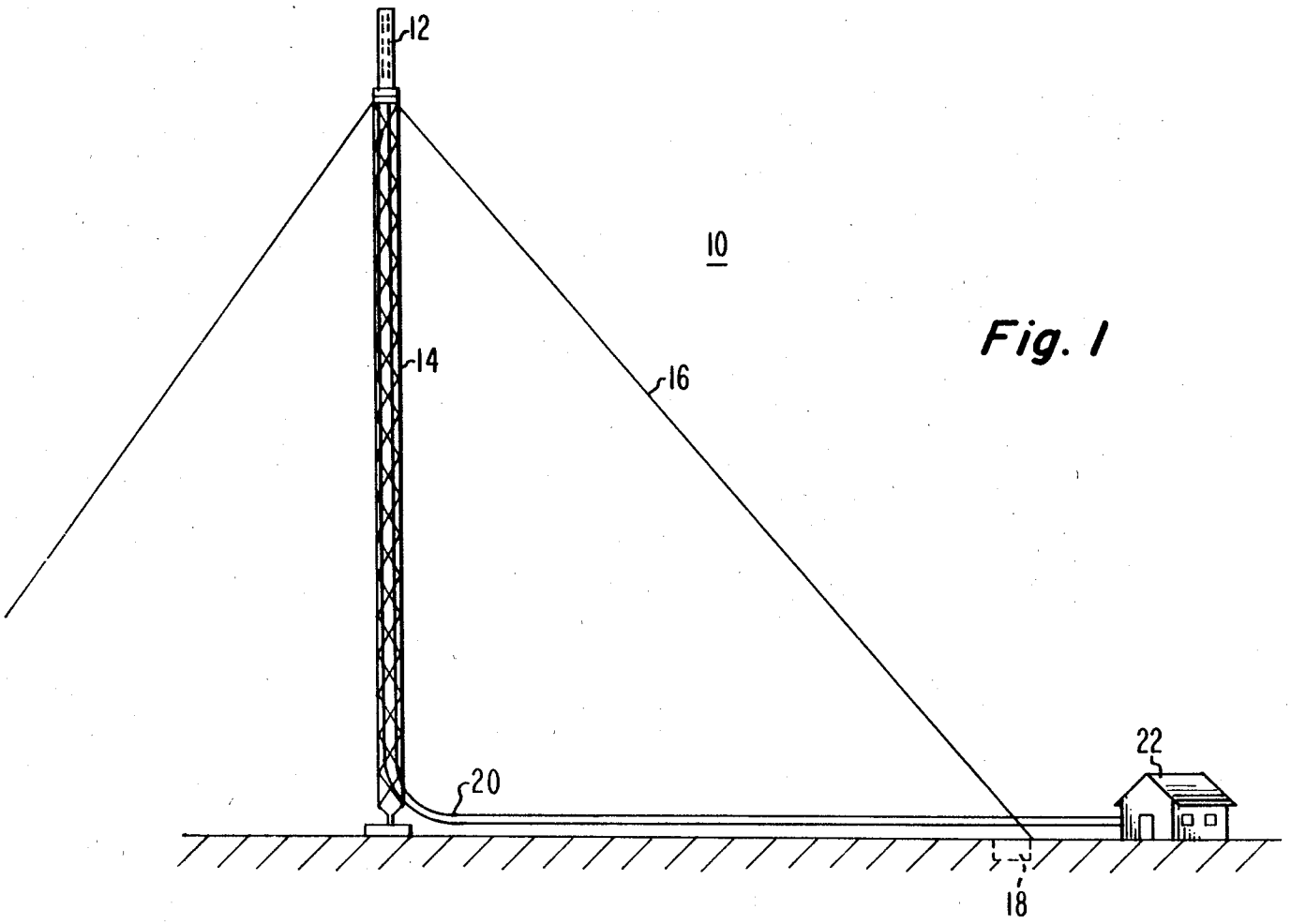
FIG. 1 illustrates generally a broadcast television system.

In FIG. 1 an antenna system designated generally as 10 includes a slotted-circular-waveguide antenna illustrated as 12 mounted atop a tower 14 guyed by guy-wires 16, (only two illustrated) attached to anchors 18. Television signals for one or more television channels are coupled to a circular waveguide port at the base of antenna 12 by a circular waveguide 20 which extends from the port at the base of antenna 12 through (or immediately outside) the tower 14 to a building 22 which houses the source of high-power signals (not shown). The circular waveguide has lower loss than a corresponding coaxial transmission line, and therefore the attenuation of the high power signals between the source in building 22 and the base of antenna 12 is minimized.

The signals flowing to the antenna through waveguide 20 include visual carrier signals amplitude-modulated with television visual information in known manner and also includes a frequency-modulated aural carrier at a level approximately 10 dB below the level of the visual carrier.

Figure 2A:
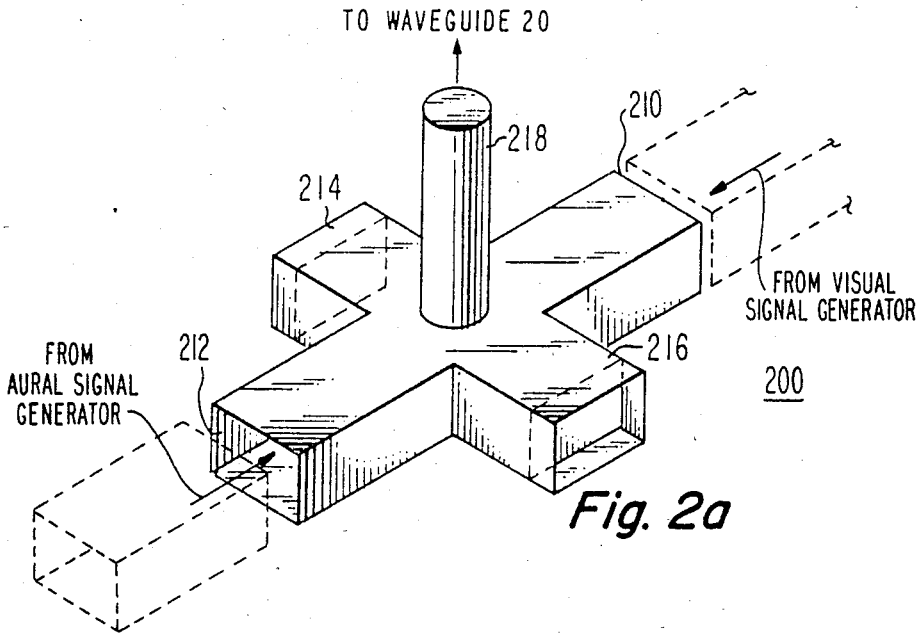
FIGS. 2*a* and 2*b* illustrate top and bottom views of a turnstile junction, respectively, and FIG. 2*c* also illustrates details of an adjuster.

FIG. 2*a* illustrates in perspective view a turnstile junction useful in conjunction with the arrangement of FIG. 1 for coupling the separately-generated visual and aural high-power signals into waveguide 20.

Figure 2B:
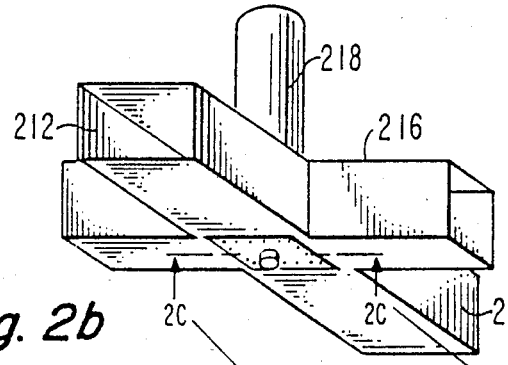
Figure 2C:
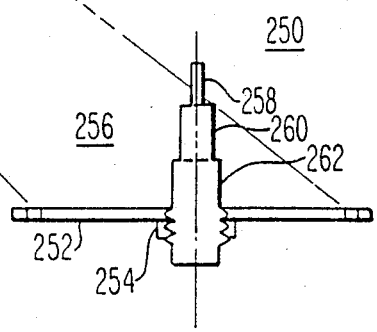

FIG. 2 illustrates a turnstile junction designated generally as 200 which includes a first pair of rectangular-waveguide ports 210 and 212 and a second pair of waveguide ports 214 and 216 which second pair is orthogonal to the first pair. A circular waveguide section 218 is coupled to a central junction of the turnstile junction. Turnstile junctions are known in the art, and are described for example in the text "Microwave Circuits" by Jerome Altman, published by Van Nostrand, 1964. The turnstile junction 200 is arranged to receive visual signals at port 210 from a rectangular waveguide coupled to the aural signal generator. Port 212 is arranged to receive aural carrier signals from a separate aural carrier signal generator by way of a matching rectangular waveguide. Ports 214 and 216 are short-circuited approximately $\frac{1}{8}$ wavelength from the center of the junction of turnstile 200. This arrangement causes the visual carrier to be propagated into waveguide section 218 with one hand of circular polarization such as right-hand circular polarization. The signals propagated from the aural signal generator (not shown) into waveguide port 212 is coupled into circular waveguide section 218 in the form of circularly-polarized signals of the opposite hand, as for example left-hand circular polarization. Thus, the high-power visual signal is propagated through waveguide 218 to waveguide 20 as a first hand of circular polarization while the aural carrier signal at a slightly different frequency is propagated into the waveguide with the other hand of circular polarization. This coupling of the two signals into the single waveguide is acomplished with substantial isolation between ports 210 and 212 and therefore with substantial isolation of the visual signal generator from the aural signal generator. The coupling is accomplished without resonators. The short-circuited waveguide sections 214 and 216 act as reactive phase-shifters for adjusting the two hands of circular polarization for 90° phase-shift therebetween. In this way, unavoidable errors due to manufacturing tolerances may be corrected.

A mode control rod such as is illustrated in FIG. 2*b* may be useful in adjusting the impedance at input ports 210 and 212, and/or for control of circular polarization at output circular waveguide port 218. The mode control rod consists as known in the art of a step-tapered rod 256 coupled coaxially with circular waveguide port 218 and electrically connected to the side of the turnstile junction opposite the circular waveguide port. The height of rod 256 is approximately the height of the rectangular waveguide, and the diameters of the sections 258, 260 and 262 are selected for best port match and circular polarization (axial ratio) of the output signal. Depth adjustment is simplified by threading the largest-diameter portion 262 of rod 256 into a threaded ring 254 affixed to removable bottom plate 252.

While the combining of the aural and visual carrier signals into the single transmission line or waveguide 20 is accomplished with low loss by the turnstile junction 200, means must be provided for coupling the two hands of circularly polarized signals propagating through the waveguide to the radiating slots of the antenna.

Figure 3:
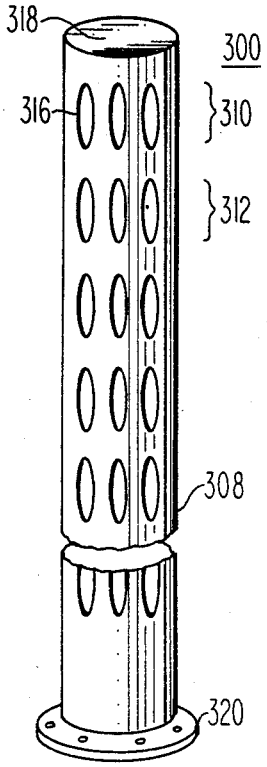
FIG. 3 illustrates generally a slotted-circular-waveguide antenna.

FIG. 3 illustrates generally a slotted-circular-waveguide antenna 300 including bays 310 312 etc. of slots, one of which is designated 316. The bays are separated by one wavelength in air, which corresponds to somewhat more than a wavelength inside the circular waveguide section into which the slots of antenna 300 are cut. A short-circuit 318 terminates the end of slotted waveguide 300, and a circular-waveguide port including a flange 320 provides an input port for driving the antenna from a circular-waveguide feed.

Figure 4A:
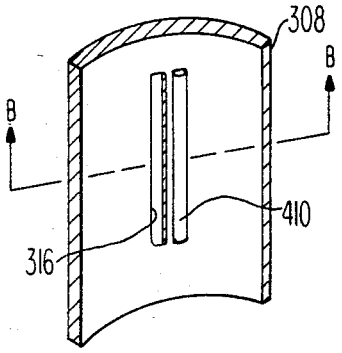
FIGS. 4*a* and 4*b* illustrates details of a coupler for a slot of the slotted antenna.
Figure 4B:
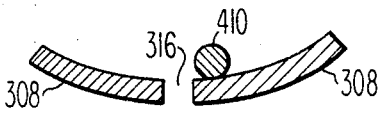

FIG. 4 illustrates the feed structure for any one of the slots (slot 316 is illustrated) for coupling the two circularly polarized signals to the slot in a manner to generate a far-field radiating pattern. In FIG. 4*a*, a portion of waveguide 308 is illustrated as seen from the inside of the circular waveguide 308. A coupler consisting of an elongated cylinder 410 is fastened by screws or by brazing adjacent to slot 316. FIG. 4*b* illustrates a cross-sectional view along parting line B—B of the slot end coupler illustrated in FIG. 4*a*. The coupler may be substantially the full length of slot 316. Coupler 410 intersects both hands of circular polarization and generates fields across the width of slot 316 in a mode necessary to produce horizontal polarization. It should particularly be noted that the two hands of polarization within the circular waveguide of antenna 300 do not result in different hands of circular polarization in the far field radiated by the slot.

Thus, the combination of a turnstile junction fed from two sources of signal and a slot antenna including couplers which are insensitive to polarization results in low-loss transmission of signal from the source of high power signals to the far field radiation without diplexer resonators.

Other embodiments of the invention will be apparent to those skilled in the art. While the invention is principally useful in the UHF frequency range because of economic considerations, there is in principal no reason why it cannot be used at lower (VHF) or higher frequencies. The reactive termination may be adjusted as required in known fashion to compensate for unavoidable tolerances in the manufacture of the turnstile junction. The slot antenna may include more or less slots vertically arrayed to change the antenna gain, and they may be distributed about 360° of the slotted cylinder or about only a portion of the cylinder. Where circularly-polarized signals are described as being generated or propagated, it will be understood that elliptically-polarized signals may be generated or propagated. The slots of the slotted-circular waveguide as described generate horizontally polarized far-field radiation, but may be arranged for circular polarization.

What is claimed is:

1. A television broadcasting system, comprising:

a source of UHF visual signal to be broadcast;

a source of UHF aural signal to be broadcast, said aural signal being associated with said UHF visual signal;

a slotted-circular-waveguide UHF antenna for broadcasting UHF television signals applied to a circular-waveguide input port;

a tower upon which said antenna is mounted for achieving wide coverage;

a turnstile junction having first and second pairs of orthogonal rectangular-waveguide input ports, said first pair of input ports comprising first and second ports, and said second pair of ports comprising third and fourth ports, and turnstile junction also comprising a circular waveguide port orthogonal to said first an second pairs of rectangular-waveguide ports;

first rectangular waveguide means coupled to said source of visual signal and to said first rectangular-waveguide port of said turnstile junction for coupling said visual signal to said turnstile junction;

second rectangular-waveguide means coupled to said source of aural signal and to said second rectangular-waveguide port of said turnstile junction for coupling said aural signal to said turnstile junction;

reactive terminating means coupled to said second pair of rectangular-waveguide ports of said turnstile junction for causing said turnstile junction to propagate said visual signal to said circular waveguide port of said turnstile junction with a first direction of first and second directions of circular polarization and for causing said turnstile junction to propagate said aural signal to said circular-waveguide port with said second direction of circular polarization; and a circular waveguide coupled at a first end to said input port of said antenna and extending along the length of said tower, and coupled at a second end to said circular-waveguide port of said turnstile junction for coupling said visual and aural signals from said turnstile junction to said antenna with said first and second directions of circular polarization, respectively, whereby said slotted-circular-waveguide antenna broadcasts said UHF visual signal and said associated UHF aural signal.

2. A television broadcasting system according to claim 1 wherein said slotted-circular-waveguide antenna comprises a coupler associated with each slot, each said coupler comprising an elongated cylindrical member mechanically coupled to a side of the associated slot.

3. A system according to claim 1 wherein said cylindrical member is within said slotted-circular-waveguide antenna, and the axis of each cylindrical member is parallel with the axis of said slotted-circular-waveguide antenna.

4. A system according to claim 1 wherein said reactive terminating means comprises short-circuit means.

5. A system according to claim 4 wherein said short-circuit means include first and second short-circuits located at positions established by considerations of circularity within said circular waveguide.

* * * * *